United States Patent [19]

Heisterberg

[11] 4,369,044

[45] Jan. 18, 1983

[54] LEVELING SYSTEM FOR DRY SEAL GASHOLDERS

[75] Inventor: Milton W. Heisterberg, Flossmoor, Ill.

[73] Assignee: GATX Tank Erection Corporation, Chicago, Ill.

[21] Appl. No.: 246,714

[22] Filed: Mar. 23, 1981

[51] Int. Cl.[3] ..... F17B 1/18

[52] U.S. Cl. ..... 48/176; 73/307; 116/228; 220/216; 220/222

[58] Field of Search ..... 48/174, 176, 179; 220/85 A, 216, 220, 221, 222; 73/305, 307; 116/228; 254/393, 394, 398, 399, 336, 337, 285, 286

[56] References Cited

U.S. PATENT DOCUMENTS

| | | | |
|---|---|---|---|
| Re. 26,264 | 9/1967 | Beach | 220/216 |
| 2,036,372 | 4/1936 | Stough | 220/222 |
| 2,350,483 | 6/1944 | Wiggins | 48/176 |
| 2,366,821 | 1/1945 | Wiggins | 48/176 |
| 2,457,762 | 12/1948 | Wiggins | 48/176 |
| 2,540,312 | 2/1951 | Allen | 48/176 |
| 2,540,773 | 2/1951 | Allen | 48/176 |
| 2,554,765 | 5/1951 | Allen | 48/178 |
| 2,579,766 | 5/1951 | Allen | 48/176 |
| 2,579,776 | 12/1951 | Allen | 48/178 |
| 3,137,548 | 6/1964 | Kinghorn et al. | 48/176 |

FOREIGN PATENT DOCUMENTS

| | | | |
|---|---|---|---|
| 411938 | 4/1925 | Fed. Rep. of Germany | 48/176 |

*Primary Examiner*—S. Leon Bashore, Jr.
*Assistant Examiner*—Michael L. Goldman
*Attorney, Agent, or Firm*—Dithmar, Stotland, Stratman & Levy

[57] ABSTRACT

In a dry seal gasholder cylindrical storage tank with a vertically-movable piston, an improved piston leveling system includes a vertically-movable weight outside the tank and connected by equal-length cables to spaced-apart support points on the piston at different distances from the weight. An array of guide sheaves on the tank define equal-length cable paths. The cables are pivotally coupled to spaced-apart points on a coupling plate to which a pair of attachment plates on the weight are also pivotally connected. Apertures in the attachment plates and the coupling plate are disposable in registry with one another for receiving a pin therethrough when the cable attachment points are in horizontal alignment, thereby to indicate equal tension in the cables.

14 Claims, 7 Drawing Figures

FIG. 1
PRIOR ART
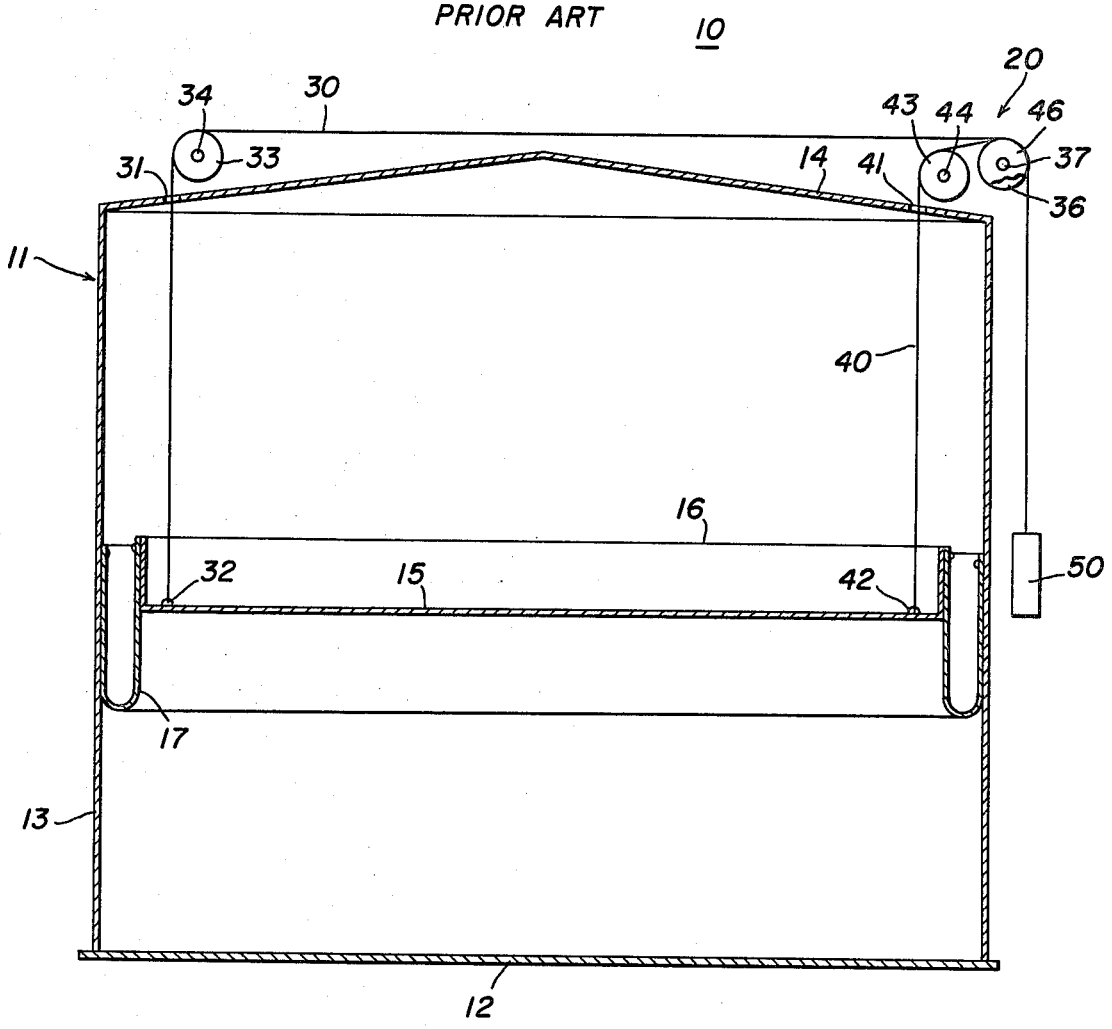
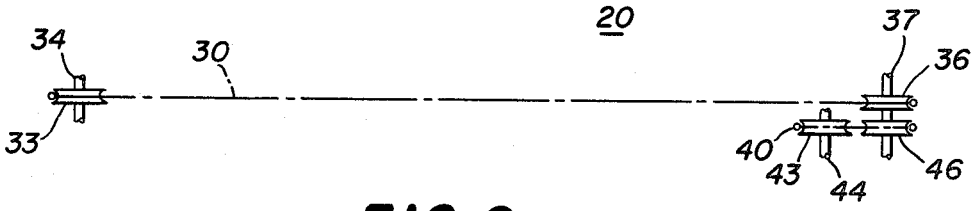
FIG. 2

LEVELING SYSTEM FOR DRY SEAL GASHOLDERS

BACKGROUND OF THE INVENTION

The present invention relates to dry seal gasholders of the type comprising a cylindrical storage tank with a vertically-movable expansion roof or piston. In particular, this invention relates to an improved piston leveling system for such a gasholder.

A typical piston leveling system for a dry seal gasholder is disclosed in U.S. Pat. Nos. 2,504,312, 2,554,765 and 2,579,776 of J. W. Allen and U.S. Pat. No. 2,457,762 of J. H. Wiggins. In this prior art leveling system, one or more weights disposed outside the tank is coupled to the piston portion of the gasholder. Each weight is typically coupled to diametrically opposed points on the piston by two cables, one of which cables is approximately one-half the length of the other cable. In operation, this type of leveling system applies an upward force equal to one-half the leveling weight to each of the opposite sides of the piston to which the weight is coupled. Any change in attitude of the piston is resisted by the leveling weight through an increase in the load applied by the weight to the low side of the piston.

While this prior art arrangement is satisfactory for gasholders up to approximately one hundred feet in diameter, it has been found to be unsatisfactory for larger gasholders. More particularly, the cables are subject to changes in length as a result of day-to-night temperature changes. The longer of the cables will undergo greater thermal changes in length, thereby changing the loading on the two cables and causing the piston to tip.

Furthermore, the prior art leveling systems have not afforded means for conveniently determining the attitude of the piston and the loading on the two cables from outside the tank.

SUMMARY OF THE INVENTION

It is a general object of the present invention to provide an improved piston leveling system for a dry seal gasholder which avoids the disadvantages of prior art leveling systems while affording additional structural and operating advantages.

It is an important object of this invention to provide a leveling system for a dry seal gasholder which is effective in gasholders over one hundred feet in diameter.

It is another object of this invention to provide an improved leveling system of the type set forth which is substantially immune to day-to-night thermal changes.

It is another object of this invention to provide an improved leveling system which permits the use of substantially equal-length cables for connecting a leveling weight to spaced-apart points on the movable piston which are at different distances from the weight.

It is still another object of this invention to provide a leveling system of the type set forth which provides a convenient indication outside the tank of the difference in tension in the two cables connected to the leveling weight.

These and other objects of the invention are attained by providing in a piston leveling system for a cylindrical storage tank with a vertically movable piston, wherein the leveling system includes a vertically movable weight disposed outside the tank and adapted to be coupled to two spaced-apart support points on the movable piston at different distances from the weight, the improvement comprising: two elongated flexible connectors of substantially equal length, each of the flexible connectors having one end thereof attached to the weight, the other ends of the flexible connectors being respectively attached to the piston support points, and guide means carried by the tank and defining two substantially equal-length paths between the piston support points and the weight, the guide means engaging the flexible connectors for guiding them respectively along the paths.

The invention consists of certain novel features and the combination of parts hereinafter fully described, illustrated in the accompanying drawings, and particularly pointed out in the appended claims, it being understood that various changes in the details may be made without departing from the spirit, or sacrificing any of the advantages, of the invention.

BRIEF DESCRIPTION OF THE DRAWINGS

FIG. 1 is a partially diagrammatic view in vertical section of a dry seal gasholder and a prior art leveling system therefor;

FIG. 2 is a fragmentary top plan view of the leveling system of FIG. 1;

DESCRIPTION OF THE PREFERRED EMBODIMENT

Figure 3:
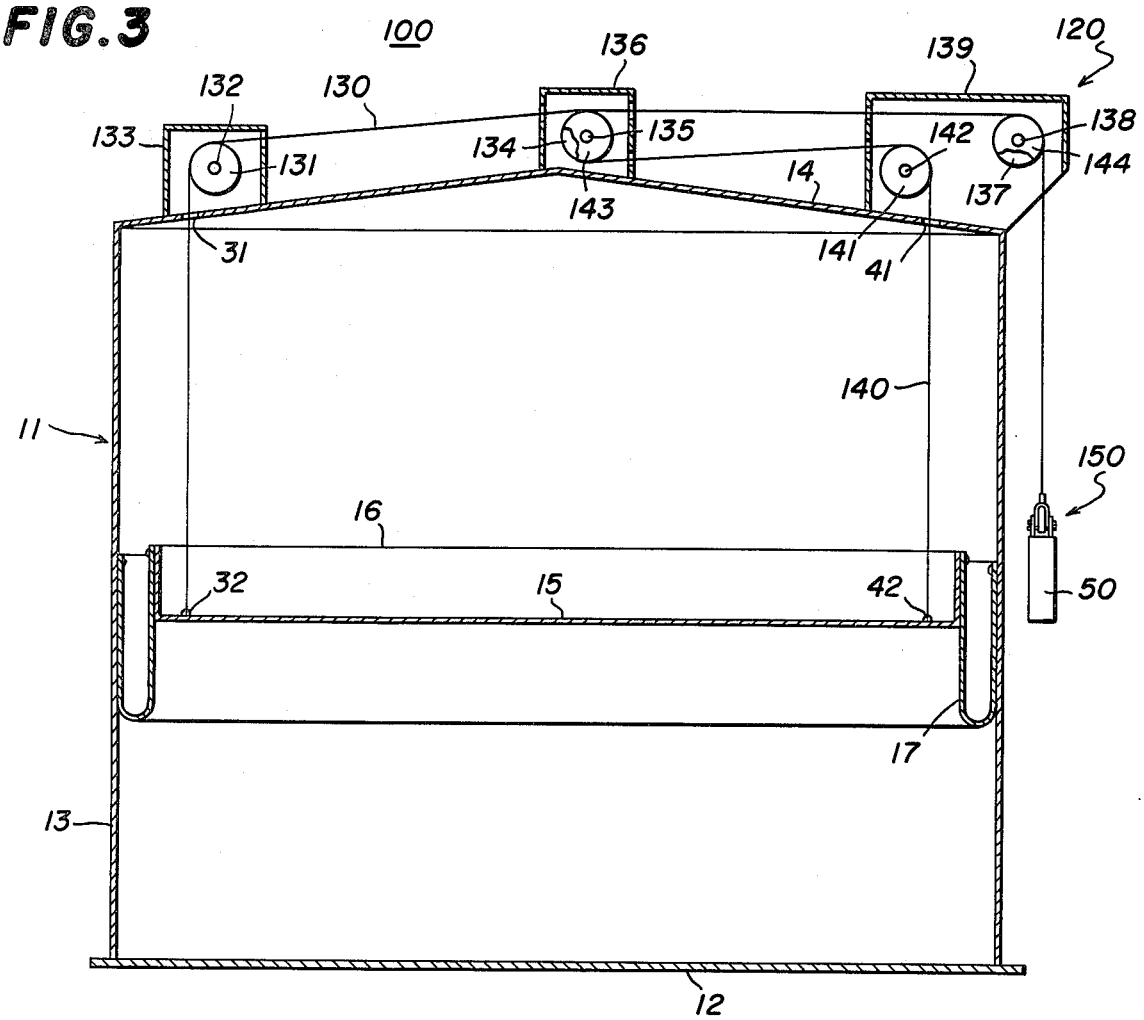
FIG. 3 is a view similar to FIG. 1, illustrating the leveling system constructed in accordance with and embodying the features of the present invention.

Referring now to FIG. 1 of the drawings, there is illustrated a dry seal gasholder, generally designated by the numeral 10, which comprises a storage tank 11 having a circular base or bottom wall 12 and an upstanding cylindrical side wall 13 closed at the upper end thereof by a generally conical weather hood or roof 14. Disposed within the storage tank 11 is an expansion roof or piston 15, which is adapted to be supported by the fluid stored in the tank 11. The piston 15 is generally in the form of a flat circular plate and is provided around the perimeter thereof with an upstanding cylindrical rim 16 which is coupled around the entire circumference thereof to the tank side wall 13 by a flexible seal member or skirt 17, all in a well-known manner.

The gasholder 10 includes a prior art leveling assembly, generally designated by the numeral 20, for maintaining the piston 15 in a level, horizontal orientation. Referring also to FIG. 2, the leveling assembly 20 essentially comprises first and second cables 30 and 40 interconnecting the piston 15 and a weight 50 outside the tank 11. The first cable 30 is relatively long and extends through an aperture 31 in the weather hood 14 and is fixedly secured to the piston 15 at a support point 32. The cable 30 extends upwardly around a guide sheave 33 which is rotatably mounted on a shaft 34 carried on the weather hood 14 by suitable support means (not shown). The cable 30 then extends across the top of the tank 11 and around a guide sheave 36 rotatably mounted on a shaft 37 carried on the weather hood 14 by suitable support means (not shown), and thence downwardly to the weight 50 to which it is securely attached.

The second cable 40 is substantially shorter than the cable 30 and extends through an aperture 41 in the weather hood 14, being fixedly secured to the piston 15 at a support point 42 which is diametrically opposite the support point 32. The cable 40 extends upwardly over a guide sheave 43 which is rotatably mounted on a shaft 44 carried on the weather hood 14 by suitable support means (not shown) and thence upwardly over a guide sheave 46 rotatably mounted on the shaft 37. The cable 40 then extends downwardly to the weight 50 to which it is fixedly secured.

It will be appreciated that the force of the weight 50 is split evenly between the two cables 30 and 40, thereby to apply to each of the support points 32 and 42 an upward force equal to one-half the weight 50. This leveling effect tends to resist any tilting of the piston 15 which might be caused by uneven pressures within the tank 11, thereby to maintain the piston 15 in a horizontal orientation.

Since the cable 30 may be as much as twice the length of the cable 40, and since the change in cable length due to temperature change is directly proportional to cable length, when the temperature rises the elongation of cable 30 may be as great as twice that of cable 40 and, when the temperature decreases, the contraction of cable 30 may be as great as twice that of cable 40. For example, as the temperature increases, the greater elongation of cable 30 will cause the load thereon to decrease and will cause the load on the cable 40 to increase, with the result that the support point 42 rises above the support point 32, throwing the piston 15 out of level.

Figure 4:
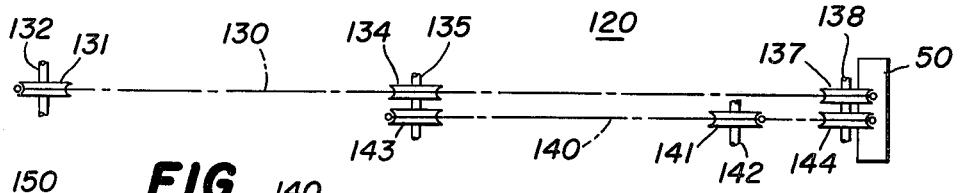
FIG. 4 is a fragmentary top plan view of the leveling system of FIG. 3.

Referring now to FIGS. 3 and 4 of the drawings, there is illustrated a gasholder 100 which comprises a storage tank 11 of the same type illustrated in FIG. 1, but having associated therewith an improved leveling assembly, generally designated by the numeral 120, constructed in accordance with and embodying the features of the present invention. The leveling assembly 120 includes two cables 130 and 140 which extend between the weight 50 and the piston 15. It is a fundamental feature of the present invention that the leveling assembly 120 is such as to permit the cables 130 and 140 to be of substantially equal length, thereby avoiding unequal response of the cables to thermal changes. The first cable 130 is fixedly secured to the piston 15 at the support point 32 and extends upwardly therefrom through the aperture 31 in the weather hood 14 and thence upwardly over a guide sheave 131 rotatably mounted on a shaft 132 supported in a suitable housing or support means indicated at 133 on the weather hood 14. The cable 130 then extends across the top of the tank 11 over a guide sheave 134 rotatably mounted on a shaft 135 in a suitable housing or support means indicated at 136, and thence over a guide sheave 137 rotatably mounted on a shaft 138 supported in a suitable housing or support means indicated at 139. The cable 130 then extends downwardly to the weight 50.

The second cable 140 is fixedly secured to the piston 15 at the support point 42 and extends upwardly therefrom through the aperture 41 in the weather hood 14 and then over a guide sheave 141 rotatably mounted on a shaft 142 in the housing 139. The cable 140 then extends across the top of the tank 11 and upwardly around a guide sheave 143 rotatably mounted on the shaft 135 and thence over a guide sheave 144 rotatably mounted on the shaft 138. The cable 140 then extends downwardly to the weight 50.

It will be appreciated that the guide sheaves 131, 134 and 137 cooperate to define a first path for the cable 130 and the guide sheaves 141, 143 and 144 cooperate to define a second guide path for the cable 140 which is substantially equal in length to the first guide path of the cable 130. Because the cables 130 and 140 are thus permitted to be of equal length, they are equally affected by day-to-night thermal changes, so that such changes do not affect the level of the piston 15.

Figure 5:
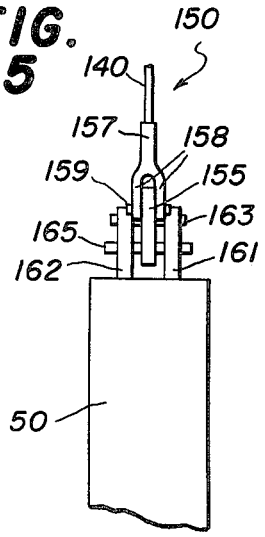
FIG. 5 is an enlarged fragmentary side elevational view of the coupling assembly for connecting the leveling weight to the cables of the leveling system of FIG. 3, illustrated in the condition of equal tension in the cables.
Figure 6:
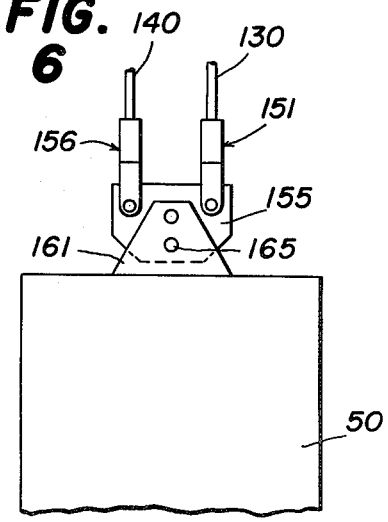
FIG. 6 is a fragmentary front elevational view of the coupling assembly of FIG. 5.
Figure 7:
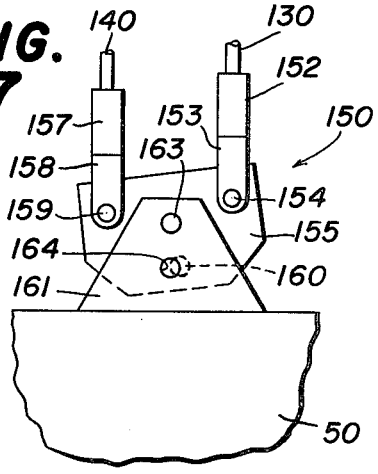
FIG. 7 is a further enlarged fragmentary view similar to FIG. 6, and illustrating the coupling assembly in a condition of different tensions in the two cables of the leveling system.

Referring also to FIGS. 5 through 7 of the drawings, there is also provided a novel coupling assembly, generally designated by the numeral 150, for coupling the cables 130 and 140 to the weight 50. More specifically, the coupling assembly 150 includes a first coupling clevis 151 having a shank 152 fixedly secured to the adjacent end of the cable 130 and a pair of legs 153 straddling one end of a flat coupling plate 155 and pivotally coupled thereto by a pivot pin 154. In like manner, there is provided a coupling clevis 156 having a shank 157 fixedly secured to the adjacent end of the cable 140 and a pair of legs 158 which straddle the other end of the coupling plate 155 and are pivotally coupled thereto by a pivot pin 159. The coupling plate 155 is in the form of a flat plate disposed in a substantially vertical plane in use, and may be of any desired shape. Preferably, however, the pivot pins 154 and 159 are spaced well apart on the coupling plate 155 and above and to either side of the center of gravity thereof. Formed in the coupling plate 155 is a circular indicating aperture 160 which is preferably disposed below the pivot pins 154 and 159 and substantially equidistant therefrom.

Fixedly secured to the weight 50 and extending upwardly therefrom are two spaced-apart substantially parallel attachment plates 161 and 162, which may be of any desired shape, but are preferably narrower at the upper ends than at the lower ends thereof so as not to interfere with the coupling clevises 151 and 156. In use, the coupling plate 155 is disposed between the attachment plates 161 and 162 and is pivotally coupled thereto by a pivot pin 163, preferably at a point on the coupling plate 155 which is between the pivot pins 154 and 159 and substantially equidistant therefrom and above the indicating aperture 160. Formed in each of the attachment plates 161 and 162 in registry with each other and adapted for registry with the indicating aperture 160 are indicating apertures 164. The apertures 160 and 164 are substantially identical in size and shape. A locating pin 165 is receivable through the apertures 160 and 164 when they are disposed in registry with one another.

The coupling assembly 150 provides a simple and effective means for determining whether or not the cables 130 and 140 are under equal tension and, therefore, whether or not equal loads are being applied to the support points 32 and 42 of the piston 15 for maintaining it level. Inequalities in cable tension may result from unequal cable stretch or wear or the like. Thus, for example, if the support point 32 is lowered with respect to the support point 42, the pivot pin 154 will be raised with respect to the pivot pin 159, as illustrated in FIG. 7, thereby tilting the coupling plate 155 and moving the aperture 160 out of registry with the apertures 164. The tilting of the coupling plate 155 gives a positive indication of the different tension loads in the cables 130 and 140. Even a minute difference in the tension loads in the cables can be detected by the coupling assembly 150 since, unless the apertures 160 and 164 are in perfect registry with one another, it will not be possible to manually insert the locating pin 165 therethrough.

Similarly, once the locating pin 165 is inserted, locking the coupling plate 155 in position with respect to the attachment plates 161 and 162, an imbalance in the tension loads in the cables 130 and 140 is still detectable. Thus, in the event of such an imbalance, the tendency of the coupling plate 155 to tilt will bind the pin 165 in the apertures 160 and 164 and prevent manual removal thereof. Whenever an unequal tension load in the cables 130 and 140 is indicated by the coupling assembly 150, the balance may be restored by appropriate shortening of the long cable or lengthening of the short cable at suitable adjustment couplings (not shown).

From the foregoing, it can be seen that there has been provided an improved leveling assembly for a dry seal gasholder which is substantially immune to day-to-night thermal changes and permits a simple and accurate determination from outside the tank of whether or not the cables are under equal tension load.

What is claimed is:

1. In a piston leveling system for a cylindrical storage tank with a vertically movable piston, wherein the leveling system includes a vertically movable weight disposed outside the tank and adapted to be coupled to two spaced-apart support points on the piston respectively by two elongated flexible connectors, the improvement comprising: a coupling member, first means pivotally connecting the flexible connectors to said coupling member respectively at two spaced-apart connector attachment points thereon, second means pivotally connecting the weight to said coupling member at a weight attachment point thereon between and substantially equidistant from said connector attachment points, and indicating means for indicating whether or not said connector attachment points are in horizontal alignment.

2. The improvement of claim 1, wherein said coupling member comprises a flat plate disposed in use in a substantially vertical plane.

3. The improvement of claim 2, wherein said first means includes two clevis members respectively fixedly secured to the adjacent ends of said flexible connectors and each straddling said coupling plate, and two pivot pins respectively extending through complementary openings in said clevis members and said coupling plate.

4. The improvement of claim 1, wherein said second means includes an attachment member fixedly secured to the weight, and a pivot pin pivotally interconnecting said attachment member and said coupling member.

5. The improvement of claim 4, wherein said second means includes a pair of spaced-apart substantially parallel attachment plates fixedly secured to the weight and respectively disposed on opposite sides of said coupling member.

6. The improvement of claim 4, wherein said indicating means includes two apertures respectively formed in said coupling member and said attachment member and disposable in registry with each other when said connector attachment points are in horizontal alignment.

7. The improvement of claim 6, wherein said indicating means further includes a locating pin receivable through said apertures when they are in registry with each other.

8. The improvement of claim 1, wherein said weight attachment point is disposed below said connector attachment points.

9. The improvement of claim 1, wherein said first means includes two clevis members respectively fixedly secured to the adjacent ends of said flexible connectors and each straddling said coupling member, and two pivot pins respectively extending through complementary openings in said clevis members and said coupling member, and wherein said second means includes an attachment member fixedly secured to the weight, and a pivot pin pivotally interconnecting said attachment member and said coupling member.

10. In a piston leveling system for a cylindrical storage tank with a vertically movable piston, wherein the leveling system includes a vertically movable weight disposed outside the tank and adapted to be coupled to two spaced-apart support points on the movable piston at different distances from the weight, the improvement comprising: two elongated flexible connectors of substantially equal length, a coupling member, means pivotally connecting one end of each of said flexible connectors to said coupling member respectively at two spaced-apart connector attachment points thereon, the other ends of said flexible connectors being respectively attached to the piston support points, guide means carried by the tank and defining two substantially equal-length paths between the piston support points and the coupling member, said guide means engaging said flexible connectors for guiding them respectively along said paths, attachment means pivotally connecting the weight to said coupling member at a weight attachment point thereon between and substantially equidistant from said connector attachment points, and indicating means for indicating whether or not said connector attachment points are in horizontal alignment.

11. The improvement of claim 10, wherein the one of said paths which extends between the weight and the nearest one of the piston support points has a folded curvilinear portion.

12. The improvement of claim 10, wherein the one of said paths extending to the piston support point nearest the weight extends from the weight upwardly to a point adjacent to the top of the tank and then radially inwardly of the tank to a point approximately centrally thereof and then back radially outwardly of the tank toward the weight and then down to the associated piston support point.

13. The improvement of claim 10, wherein said coupling member comprises a flat plate disposed in use in a substantially vertical plane.

14. The improvement of claim 10, wherein said attachment means includes an attachment member fixedly secured to the weight, said indicating means including two apertures respectively formed in said coupling member and said attachment member and disposable in registry with each other when said connector attachment points are in horizontal alignment, and a pin receivable through said apertures when they are in registry with each other.

* * * * *